US006190434B1

(12) United States Patent
Borgianni et al.

(10) Patent No.: US 6,190,434 B1
(45) Date of Patent: Feb. 20, 2001

(54) METHOD FOR DETERMINATION AND CONTROL OF THE AMOUNTS OF NITROGEN DISSOLVED IN METALLIC LIQUID PHASES AND DEVICE FOR ITS REALIZATION

(75) Inventors: Carlo Borgianni, Rome; Antonello Di Donato, Pescara; Maria Ilaria Pistelli, Rome, all of (IT)

(73) Assignee: Centro Sviluppo Materiali S.p.A., Rome (IT)

( * ) Notice: Under 35 U.S.C. 154(b), the term of this patent shall be extended for 0 days.

(21) Appl. No.: 09/105,819

(22) PCT Filed: Dec. 30, 1996

(86) PCT No.: PCT/EP96/05860

§ 371 Date: Jun. 26, 1998

§ 102(e) Date: Jun. 26, 1998

(87) PCT Pub. No.: WO97/24464

PCT Pub. Date: Jul. 10, 1997

(51) Int. Cl.[7] ..... C21C 5/30

(52) U.S. Cl. ..... 75/385; 266/80; 266/99

(58) Field of Search ..... 75/385; 266/80, 266/99

(56) References Cited

U.S. PATENT DOCUMENTS 5,522,915 * 6/1996 Ono et al. ..... 75/385

OTHER PUBLICATIONS

Patents Abstracts of Japan, Publication No. JP56136915, Oct. 1981.

* cited by examiner

*Primary Examiner*—Melvyn Andrews
(74) *Attorney, Agent, or Firm*—Hedman, Gibson & Costigan, P.C.

(57) ABSTRACT

The present invention refers to a method for determination and control of the amount of nitrogen dissolved in metallic liquid phases and to a device permitting, when placed in the steel producing plant and for instance in the tundish or in the continuous casting mold, the determination of nitrogen content directly from the liquid phase. Such a device can point out possible nitrogen pick-up in real-time, thus permitting to immediately intervene.

15 Claims, 1 Drawing Sheet

METHOD FOR DETERMINATION AND CONTROL OF THE AMOUNTS OF NITROGEN DISSOLVED IN METALLIC LIQUID PHASES AND DEVICE FOR ITS REALIZATION

The present application is the national stage filing of and claims priority to International Application No. PCT/EP96/05860, filed Dec. 30, 1996 and Italian Application Ser. No. RM95A000862.

FIELD OF INVENTION

The present invention refers to a method for determination and control of the amount of nitrogen dissolved in metallic liquid phases and to the device for its realization.

The invention particularly refers to a device permitting a high measurement rate.

STATE OF THE ART

It is known that the in-line control of production processes actually has a direct positive influence both on production economy and on the quality of the end product. It is therefore important to have data acquisition systems able to give quick and reliable answers, to permit a real-time monitoring of a process and relevant timely adjustments, if necessary.

In the iron and steel field, it is particularly needed the possibility of a continuous in-line monitoring of the concentration of such elements as nitrogen and hydrogen which are dissolved into the liquid steel from the gaseous environment and negatively influence the mechanical and physical characteristics of the end product.

Such on-line monitoring is described, for instance, in a Japanese patent application (Appl. No. JP800039365 of Mar. 26, 1980) in which flue gas leaving a converter is sampled and analyzed for CO, $CO_2$ and $N_2$, in order to detect the occurrence of foaming in the converter.

Nitrogen leads to hardening and fragility of ferrous alloys, thus being highly dengerous for steel products such as plates, gas pipes, deep-drawing sheets utilized in car bodies or domestic appliances production, for instance.

The typical phase for nitrogen absorption from the atmosphere is during the steel transfer from the ladle to the mould, through the tundish.

The determination of nitrogen content in liquid steel, directly in the steel shop, and preferably within the mould, could determine in real-time any rise in nitrogen concentration, thus permitting to timely intervene, in well known ways, to lower nitrogen pick-up and eliminate its excess from the metal bath.

In the control of metallic materials production, particularly during the step in which such materials are in the liquid state, up to now the determination of dissolved chemical species, especially gases, was made through quickly solidified metal samples sent to the laboratory for analysis. Such a method, though accurate with errors within 5%, is not a satisfying one, due to excessive delay for the answer, tipically of 10–30 minutes, which does not allows for timely bath composition adjustments.

A device for nitrogen determination in the liquid steel is available from Hereus-ElectroNite International N.V. The measurement method requires the immission into the liquid bath of an inert carrier gas, specifically helium. The nitrogen dissolved into the liquid steel is then divided, according to known laws, between metal and gas, and in the latter tends to a concentration, according to the Henry-Sieverts law, in equilibrium with, and proportional to, the one within the liquid bath.

From the gas coming out from the bath, and containing all the chemical species extracted from the same, all the species interfering with the nitrogen analysis are eliminated through specific molecular sieves, and the purified gas is sent to the analysis made utilizing known apparatuses for thermal conductivity determination.

The probe for introducing into the liquid bath a specific amount of helium, and for sampling it and send it to the analysis, is a disposable one and can give an answer in about 90 seconds, with a declared accuracy of 10%.

It is possible to enhance this accuracy utilizing a well known artifice. After a first measure, a new extraction operation is started utilizing as carrier gas a mixture of helium and nitrogen in which the nitrogen content corresponds to the one previously determined, and the measure is repeated. If the new measure is identical to the previous one, the latter was correct; if a nitrogen content is determined higher than the previous one, the actual nitrogen content of the bath is higher than the one obtained in the previous measure, while if the newly determined content is lower, the bath has a lower nitrogen content. The above artifice permits to obtain an accuracy of about 5%. Such probes for the nitrogen determination, though representing an interesting progress with respect to the classic technique of laboratory analysis, still maintain even important drawbacks:

are of the disposable kind, allowing only a single determination at a time, thus not permitting a continuous monitoring;

it is practically impossible to introduce the probes into the mould with the necessary high cadence, first of all because it is forbidden to stay under the ladle during the casting and then because, even if it should be possible, the presence of casting powders and of semiliquid slag on the bath surface into the mould would make it highly difficult to correctly introduce the probe at the location and within the desired time;

the measure time of 90 seconds is still too long for some kind of intervention, and anyway it have to be strictly maintained: in fact, different residence times of the probe into the bath would make meaningless the measure;

in the nitrogen determination, it is necessary to utilize as carrier gas helium, which is very costly and usually not available in a steel shop.

It is still unsolved the problem of the quick and accurate determination of the nitrogen content in liquid metal baths, in a continuous way or at least with a very short time interval from measure to measure.

SUMMARY OF THE INVENTION

It was now realized, and is part of present invention, a device permitting, when placed in the steel producing plant and for instance in the tundish or in the continuous casting mould, the determination of nitrogen content directly from the liquid phase. Such a device can point out possible nitrogen pick-up in real-time, thus permitting to immediately intervene.

Another aspect of present invention is the method for the determination and control of the nitrogen content of metal baths through said device.

Other objects of present invention shall be evident from the following detailed desctiption of the invention.

DETAILED DESCRIPTION OF THE INVENTION

Figure 1:
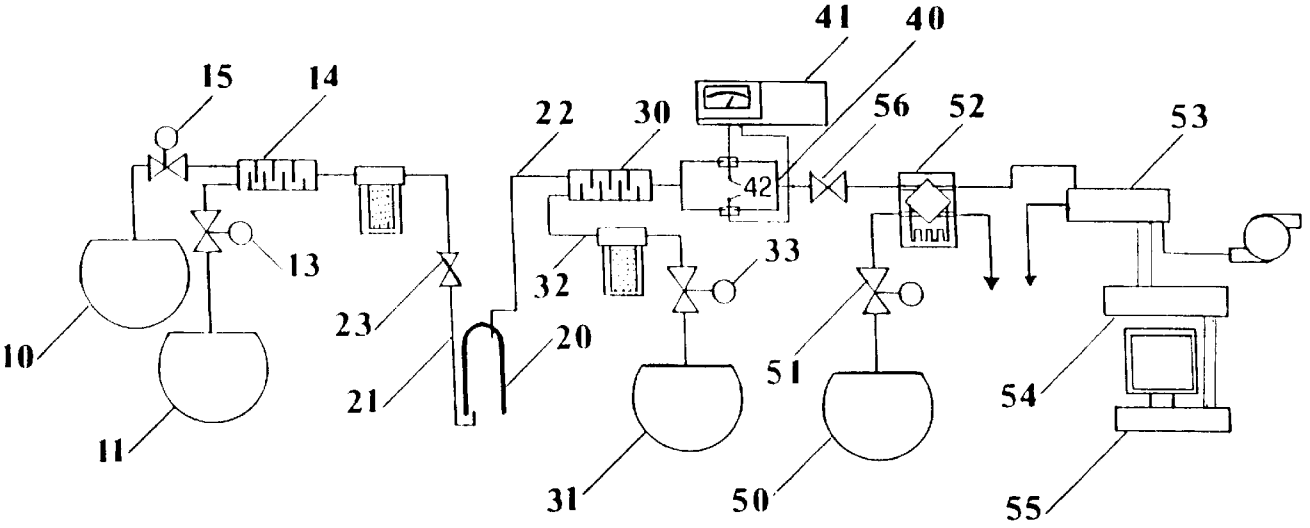
FIG. 1 is a general scheme of the device according to present invention.

For a better understanding, present invention will be described starting from its realization method, which will make it simpler the following description and understanding of relevant device.

To each phase of the process a part of the device is logically and operatively connected, as apparent from the following description.

The method for the determination and control of nitrogen content in metal baths, according to present invention, comprises the following steps:

introducing into the liquid metal (in the following description also called metal bath or simply bath) a known quantity of inert carrier gas, for instance argon also mixed with other gases such as nitrogen, to promote a nitrogen exchange between the bath and the carrier gas;

withdrawing the carrier gas passed through the bath and containing nitrogen, adding to it a known quantity of oxygen and homogenizing the gas mixture thus obtained;

oxidizing the nitrogen contained in said gaseous mixture to nitrogen oxides, mainly $NO_2$ and small quantities of NO;

measuring the $NO_2$ content in said mixture and correlating it to the nitrogen content in the bath;

charging said analysys data in a computer and utilizing them control the nitrogen content in the metal bath.

The carrier gas flow rate into the metal bath is comprised between 3 and 30 liters per hour.

The oxygen flow rate to be added to the carrier gas passed through the bath is from 40 to 70% of flow rate of carrier gas and the mixture is throughly homogenized and then treated to catalyze the nitrogen combustion to $NO_2$, and small quantities of NO.

Preferably, the homogenized gaseous mixture is subjected to electric sparks of between 3000 to 8000 V, to oxidize nitrogen to mainly $NO_2$.

The $NO_2$ content of the thus obtained gaseous mixture is measured with known methods, and is correlated to the nitrogen content in the liquid metal bath, and the thus obtained concentration is utilized according to known methods to adjust, if necessary, the nitrogen content in the metal bath and hence to check and control the final quality of the products obtained from said metal bath.

The production of small quantities of NO during the nitrogen combustion does not invalidate the method. In fact, the NO quantity is very small and its measure can be considered within the background noise, thus not significantly influencing the $NO_2$ measure. To avoid "interpollution" of different measurements, the $NO_2$ containing gas is sent to the analyzer in a non-continuous way, at regular time intervals as known volumes, utilizing an inert carrier gas, e.g. argon. Between a gas volume to be analyzed and the next one, the analyzer is fed with pure carrier gas, to purge any residual quantity of $NO_2$. The gas volume to be analyzed, sent to the analyzer, is comprised between 0.3 amd 5 ml, while the carrier gas flow-rate during this step is between 5 and 20 l/h.

With the utilized experimental apparatus, it is possible to perform quick measurements, typically a measure in 15–25 s, with an error lesser than 10%, improvable to less than 5% utilizing a double-measure system, as hereinafter specified.

The measures cadence (2–4 measures per minute, instead of 0.6 measures per minute of known methods), though not permitting continuous measures, is however sufficiently quick to permit timely actions to control the nitrogen content in the liquid bath.

The device according to present invention for the embodiement of the above method, comprises the combination in cooperation relationship of:

means for bubbling and picking-up a gas, enabling to inject an inert gas into a metal bath, thus realizing a nitrogen exchange between said bath and the injected gas, and to collect the obtained gas mixture;

means for extracting said gas mixture from said bubbling and picking-up means;

means for adding desired quantities of oxygen to said extracted mixture and means for homogenizing the gaseous mixture thus obtained;

means to subject the nitrogen contained in said homogenized gaseous mixture to a catalyzed oxidation;

means for measuring the $NO_2$ content in said oxidated gaseous mixture;

means to acquire data relating to $NO_2$ content in the oxidized gaseous mixture, transforming them in nitrogen content in the metal bath and utilizing them to monitor and modify, if necessary, the nitrogen content of the bath.

The means for bubbling and picking-up a gas substantially comprise an element, for instance of an elongated tubular form, for picking-up the introduced gas, having a first conduit with a downwardly facing opening for the admission into said element of the gas to be bubbled through the bath, and a second conduit connected to said means for extracting the collected gas, for instance consisting in a rotary pump.

The means for adding to the extracted gas known quantities of oxygen and for homogenizing the thus obtained mixture consist in an oxygen tank having means for controlling, measuring and purifying the outcoming oxygen flow, and in a conduit for admitting gas into a chamber, having openings for amitting and extracting gas, in which the extracted gas and oxygen are admitted. Said chamber is provided with a plurality of projections, for instance suitably located walls, to enhance the turbulence of the gases passing through said chamber and thus obtain a homogeneous gas mixture.

Said means to oxidize the nitrogen in said homogenized gaseous mixture consist, for instance, in a reactor internally provided with means to subject the gaseous mixture containing nitrogen and oxygen to a catalytic oxidation reaction of the nitrogen, mainly to $NO_2$. In said reaction, the oxidation efficiency of tne nitrogen (i.e. the ratio $NO_2$/NO) is constant.

Preferably, said means to subject the gas to a catalytic oxidation consist in at least a couple of electrodes, e.g. platinum ones, between which a tension is established sufficiently high to establish an electric arc.

Said means for measuring the $NO_2$ content in the gases coming out the reactor can be any sensor; preferably, said sensor comprises (i) a first conduit in which the gaseous mixture containing a component to be measured flows with laminar motion, (ii) a second conduit in which a carrier liquid, in which said component is soluble, flows with laminar motion, (iii) a membrane permeable only to said component and constituting a separating wall between said first and said second conduits, and (iv) a reference electrode and a measure electrode, sensing the concentration of said component, both placed in said second conduit.

The linear speed of the carrier liquid on the semipermeable membrane is comprised between $10^{-1}$ and $10^{-5}$ m/s while the gas linear speed on the membrane is lesser than 5 m/s.

The reference electrode is placed in said second conduit before said membrane, thus being always immersed in clean carrier liquid and therefore maintaining constant its potential, which is the reference potential. Said reference electrode has an wetted surface greater than the one of the measure electrode, preferably from 2 to 5 times greater.

The semipermeable membrane is made with a porous hydrofobic polymer, with a mead pore diametre of 1 micrometer.

The gaseous mixture flows within the space between first and second conduits, and the carrier liquid flows within said second conduit in countercurrent with respect to the gaseous mixture, as a thin layer over the semipermeable membrane; its flow rate is comprised between 0.005 and 0.1 ml/s, preferably between 0.01 and 0.03 ml/s, its thickness being comprised between 2 and 0.05 mm, preferably between 1 and 0.1 mm.

Said means to acquire data concerning the $NO_2$ content in the gas and for correlating them to the nitrogen content in the metal bath comprise a computer provided with a standard program and with specific calibration curves, which can be obtained in any known way.

It is to be noted that though the above device, particularly the sensor, is described only with reference to the analysis of $NO_2$, it can be easily utilized for the analysis of other species, of both acid and basic nature.

Coming now to the enclosed Figures, the means for bubbling and picking-up the gas comprise a refractory collecting vessel (20) resistant to thermal shocks, preferably in silicon carbide, provided with a conduit (21), having flow controlling means (23), for introducing a carrier gas and provided also with a second conduit (22) to withdraw said gas from said vessel. The carrier gas, typically argon, flows within conduit (22) coming from a tank (11), and its flow rate is measured and controlled by a regulating flowmetre (13).

In operation, the vessel (20) is immersed into the metal bath with its opening facing downwardly, to a level comprised from 100 to 300 mm, and valve (23) is opened, allowing the carrier gas to bubble within the bath, activating the nitrogen exchange between bath and gas.

The gas coming out of the bath and enriched with nitrogen is then sent, by means of a pump (not shown), and of conduit (22) to the mixer/homogenizer (30) into which is mixed with oxygen coming from tank (31) through conduit (32) with a desired flow rate, measured and controlled by flowmetre (33). The mixer/homogenizer (30) comprises a sealed chamber internally provided with deflecting walls, helical paths and the like permitting to homogenize the gaseous mixture consisting of argon, nitrogen and oxygen which is then sent to the reactor (40). The latter (Giggs 1 and 2) comprises a tubular chamber, containing at least a pair of electrodes (42) facing to each other; between said electrodes and port (45) for the immission of the homogenized gaseous mixture into chamber (40) a narrowing (44) is placed, preferably having a conical form, to send the gaseous mixture flow exactly in the space existing between the electrodes (42), in which an electric sparks are generated through a generator (41), as described with reference to the embodiment method. Thus, the energy of the electric sparks catalyzes the nitrogen combustion, mainly to $NO_2$. The generation of NO during the above process does not impair the validity of the measures, in that NO concentration is very small and the $NO_2$/NO ratio is practically constant.

Figure 3:
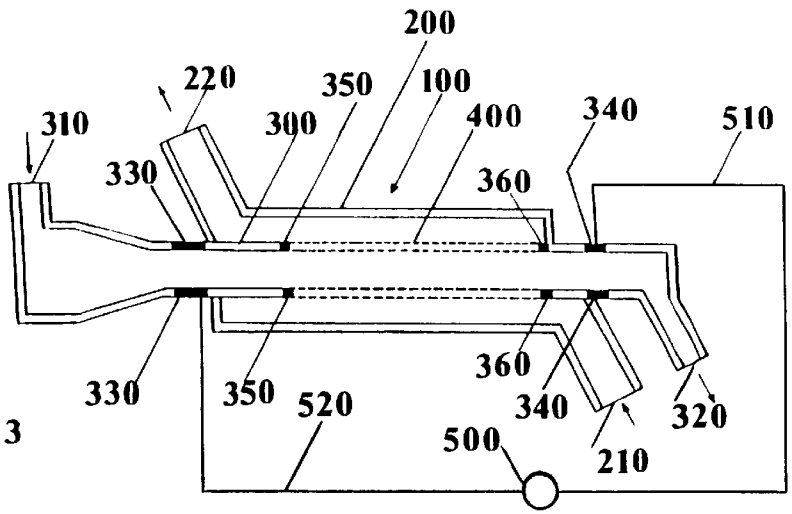
FIG. 3 is an enlarged schematic longitudinal section of a sensor particularly suited to measure the $NO_2$ content in the gas.
Figure 2:
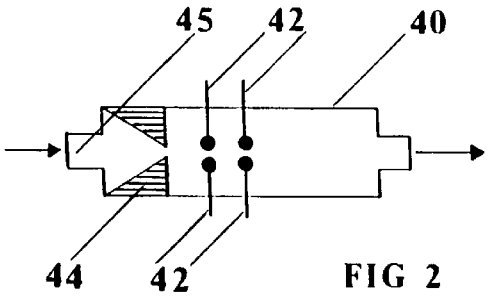
FIG. 2 schematically shows the reactor according to FIG. 1 for the nitrogen oxidation.

During the measures the $NO_2$ containing mixture, thus obtained, is sent to the analysis device (53), which can be of the kind illustrated in FIG. 3. This device (100) comprises: (i) a first conduit (200) having an inlet opening (210) and a discharge opening (220), (ii) a second conduit (300) also having an inlet opening (310) and a discharge opening (320), and comprising a membrane (400) semipermeable to gases the extremities (350, 360) of which are connected to metallic tubular elements containing (iii) a pair of reference (330) and measure (340) electrodes.

Conduit (300) is internal and coaxial to conduit (200), and its metallic extremities, preferably made in stainless steel, comprise a first oxidized and stabilized zone (330), acting as reference electrode, and a second oxidized and stabilized zone (340), acting as measuring electrode. The reference electrode is from 20 to 50% of the length of the measuring electrode. Cables (510, 520) respectively connect electrodes (330) and (340) to a measure instrument (500), in this case a millivoltmeter.

The oxidized gaseous mixture is periodically sent to the analyzer as constant and known volumes controlled by a flowmetre (56) and by a four-ways cock (52), utilizing a carrier gas, argon for instance, erogates at a constant rate by a reservoir (50) through a flowmetre (51).

An important advantage of the device according to present invention is that vessel (20) can be permanently placed into the liquid bath, e.g. into the continuous casting mould, where can work during the entire casting process. This means that vessel (20) can be put in place before starting the casting operations (then easily and in complete safety for the operators) and continuously works for many hours without modifying the operating conditions of the plant.

The device according to the invention can pinpoint on the line and within 15–25 seconds any unduly high nitrogen content into the bath, allowing to timely operate to reduce said nitrogen content thus avoiding a downgrading of the end product.

The device according to the invention can measure $NO_2$ contents even smaller than 1 ppm, on very small gas volumes.

According to the present invention, the measure error of the nitrogen content in the metal bath is around 10%, depending on the uncertainties introduced by bath temperature variations and bath content of such elements as sulphur and oxygen, which can influence the exchange cinetics of nitrogen between metal bath and gas.

It is possible to improve such figures utilizing a double-analysis technique, according to which after a first measure, obtained as above described, a second one is made, passing through the bath a nitrogen-argon mixture in which the nitrogen, coming from tank (10) and measured by flowmeter (15), has a content corresponding to the one in equilibrium with the nitrogen in the bath, known from the first measure; the mixture is homogenized in the mixer (14).

If in said second measure the nitrogen content in the mixture passed through the bath is really in equilibrium with the bath, there will be no change in the nitrogen content in the gaseous mixture, and the measure will remain unchanged. On the other hand, should the measured concentrations be different, it is possible to desume, in a known way, the nitrogen concentration in equilibrium with the bath through solution of systems of differential cynetics equations. From this value, the Henry-Sieverts law allows to obtain the real concentration of nitrogen in the bath.

It is thus possible to enhance the accuracy of the measures, at the expense of a doubling of the time necessary for each measure; however, a cadence of less than 50 seconds can be considered acceptable in most cases.

What is claimed is:

1. Method of measuring and controlling the nitrogen content in a liquid metal bath, in which an inert carrier gas is bubbled through said liquid metal bath to promote a nitrogen transfer from said bath to said carrier gas, thus forming a first gaseous mixture comprising said carrier gas and nitrogen, said mixture being collected and withdrawn from said metal bath, characterized in that (i) a known quantity of oxygen is added with a known flow rate to said first gaseous mixture to form a second gaseous mixture comprising carrier gas, nitrogen and oxygen; (ii) the nitrogen contained in said second gaseous mixture is oxidized to nitrogen oxides, comprising $NO_2$; (iii) the $NO_2$ amount thus formed is measured and correlated to the nitrogen content in said liquid metal bath; (iv) the thus obtained $NO_2$ amount and correlated nitrogen content in said liquid metal bath are then loaded in a computer which compares them with a desired nitrogen content in the metal bath, and displays necessary measures to bring the measured nitrogen content in said metal bath to the said desired nitrogen content.

2. Method according to claim 1, in which the carrier gas is argon.

3. Method according to claim 2, in which the carrier gas comprises nitrogen.

4. Method according to claim 1, in which the carrier gas flow rate through the metal bath is comprised between 3 and 30 liters per hour.

5. Method according to claim 1, in which the flow rate of oxygen added to said first gaseous mixture is from 20 to 70% of the flow rate utilized for said carrier gas.

6. Method according to claim 1, in which said second gaseous mixture comprising nitrogen and oxygen, as well as carrier gas, is treated to catalyze the nitrogen combustion to nitrogen oxides, comprising $NO_2$.

7. Method according to claim 6, in which said treatment of said second gaseous mixture to catalyze the nitrogen combustion to nitrogen oxides comprising $NO_2$ and form a gaseous mixture comprising nitrogen oxides, consists in subjecting said second gaseous mixture to electric sparks generated by a electrical potential difference of between 3000 and 8000 volts.

8. Method according to claim 7, in which the gaseous mixture comprising nitrogen oxides is sent to an analyzer for the determination of the $NO_2$ content which, in turn, is correlated to the nitrogen concentration in the liquid metal bath, and said concentration is utilized to adjust the nitrogen content in the metal.

9. Device for the embodiment of the method of claim 1, characterized in that it comprises (i) means (20, 21, 23) for bubbling an inert gas into a liquid metal bath, thus realizing a nitrogen transfer from said metal bath to said inert gas, to form a first gaseous mixture comprising inert gas and nitrogen; (ii) means (22) for collecting said first gaseous mixture; (iii) means (31, 32, 33) for adding with a known flow rate desired quantities of oxygen to said first gaseous mixture, to obtain a second gaseous mixture comprising carrier gas, nitrogen and oxygen, and means (30) for homogenizing said second gaseous mixture; (iv) means (40, 42, 43) to oxidize to nitrogen oxides, comprising $NO_2$, the nitrogen contained in said second gaseous mixture; (v) means (53, 100) for measuring the $NO_2$ content in said oxidized second gaseous mixture; (vi) means (54, 55) for processing said measured $NO_2$ content and relating to the nitrogen content in the bath.

10. Device according to claim 9, in which said means for bubbling an inert gas substantially comprise an elongated element (20) provided with an internal space and having a first opening at one of its extremities, a first conduit (21) for admission into said internal space of the inert gas and of a second opening provided with said means (22) for extracting bubbled gas, consisting in a second conduit and means to control the gas flow.

11. Device according to claim 9, in which said means for adding to the extracted gas known quantities of oxygen and for homogenizing the thus obtained gaseous mixture consist in an oxygen tank (31) having means (33) for controlling and measuring the outcoming oxygen flow, and in a chamber (30), having openings for admitting and discharging gas, in which the extracted gas and oxygen are admitted, said chamber being provided with a plurality of projections to enhance the turbulence of the gas passing through said chamber, thus obtaining a homogeneous gas mixture.

12. Device according to claim 9, in which said means to oxidize the nitrogen in said homogenized gaseous mixture comprise means (42) to subject the gaseous mixture containing nitrogen and oxygen to a catalytic oxidation reaction of nitrogen to nitrogen oxides, comprising $NO_2$.

13. Device according to claim 12, in which said means (42) to subject the gaseous mixture to a catalytic oxidation comprise at least two electrodes between which a sufficient electric voltage is provided to establish an electric arc.

14. Device according to claim 9, in which said means (53, 100) for measuring the $NO_2$ content in the gas coming out of the reactor comprise (i) a first conduit (200) in which the gaseous mixture containing $NO_2$ flows with laminar flow, and is provided with an inlet opening (210) and a discharge opening (220); (ii) a second conduit (300), adjacent to the first one, through which a carrier liquid, in which $NO_2$ is soluble, flows with laminar flow in countercurrent with said gaseous mixture, said second conduit having an inlet opening (310) and a discharge opening (320); (iii) a membrane (400) in a hydrophobic polymer permeable only to said $NO_2$, and constituting a separating wall between said first and second conduits, and (iv) a couple of reference (330) and measuring (340) electrodes, respectively placed in said conduit (300) at the extremities of said membrane (400).

15. Device according to claim 11, in which said second conduit (300) comprises stainless steel elements carrying a reference electrode (330), consisting in a first oxidized and stabilized surface part of a first of said stainless steel elements, and a measuring electrode (340), consisting in a second oxidized and stabilized surface part of a second of said stainless steel elements, said measuring electrodes (340) having a length comprised between 20 and 50% of the length of reference electrode (330).

* * * * *